US010946295B2

(12) United States Patent
Kiani

(10) Patent No.: US 10,946,295 B2
(45) Date of Patent: Mar. 16, 2021

(54) AMUSEMENT RIDE WITH CONTROLLABLE HELICAL MOTION OF AN ECCENTRIC RIDER AROUND THE CENTRAL AXIS OF THE ROUTE OF THE RIDER

(71) Applicant: Ali Kiani, Coquitlam (CA)

(72) Inventor: Ali Kiani, Coquitlam (CA)

(73) Assignee: Ali Kiani, Vancouver (CA)

( * ) Notice: Subject to any disclaimer, the term of this patent is extended or adjusted under 35 U.S.C. 154(b) by 0 days.

(21) Appl. No.: 16/959,120

(22) PCT Filed: Dec. 21, 2018

(86) PCT No.: PCT/CA2018/051667
§ 371 (c)(1),
(2) Date: Jun. 29, 2020

(87) PCT Pub. No.: WO2019/134034
PCT Pub. Date: Jul. 11, 2019

(65) Prior Publication Data

US 2021/0031116 A1 Feb. 4, 2021

(30) Foreign Application Priority Data

Jan. 2, 2018 (CA) ..... CA 2990653

(51) Int. Cl.

| | |
|---|---|
| ***A63G 21/08*** | (2006.01) |
| ***A63G 21/04*** | (2006.01) |
| ***A63G 21/12*** | (2006.01) |
| *A63G 7/00* | (2006.01) |

(52) U.S. Cl.
CPC ..... *A63G 21/08* (2013.01); *A63G 21/04* (2013.01); *A63G 21/12* (2013.01); *A63G 7/00* (2013.01)

(58) Field of Classification Search
CPC ..... A63G 21/04; A63G 21/08; A63G 21/12; A63G 7/00; A63G 21/20; A63G 31/02
USPC ..... 104/74–76
See application file for complete search history.

(56) References Cited

U.S. PATENT DOCUMENTS

| | | | | |
|---|---|---|---|---|
| 6,523,479 | B1 * | 2/2003 | Schilke | A63G 7/00 104/57 |
| 6,606,953 | B2 * | 8/2003 | Mares | A63G 1/00 104/63 |
| 6,758,144 | B2 * | 7/2004 | Raidt | A63C 19/10 104/53 |
| 7,610,859 | B1 * | 11/2009 | Dietrich | A63G 21/08 104/53 |
| 7,980,181 | B2 | 7/2011 | Heaslip et al. | |
| 8,066,576 | B2 * | 11/2011 | Threlkel | A63G 21/04 472/47 |
| 8,393,275 | B2 * | 3/2013 | Jacobi | A63G 7/00 104/53 |
| 9,144,745 | B2 * | 9/2015 | Snyder | A63G 21/08 |
| 9,486,135 | B1 * | 11/2016 | Fram | A63G 7/00 |
| 10,799,804 | B2 * | 10/2020 | Walser | A63G 21/08 |
| 2019/0022537 | A1 * | 1/2019 | Cummins | A63G 21/04 |

* cited by examiner

*Primary Examiner* — Zachary L Kuhfuss

(57) ABSTRACT

An amusement ride enabling at least one rider to change a position of said at least one rider around at least one cylindrical vehicle while said at least one cylindrical vehicle carries said at least one rider along a central axis of said at least one cylindrical vehicle during a riding.

20 Claims, 15 Drawing Sheets

AMUSEMENT RIDE WITH CONTROLLABLE HELICAL MOTION OF AN ECCENTRIC RIDER AROUND THE CENTRAL AXIS OF THE ROUTE OF THE RIDER

FIELD OF THE INVENTION

The invention relates to the field of amusement rides. More particularly, the invention to be used to enable at least one rider to change and control his position around a cylinder while enables said at least one rider to change and control a speed along a central axis of the cylinder. Said at least one rider travels along a helical route around the central axis of the cylinder while controls a pitch, and a direction of the helical route.

BACKGROUND

Roller coasters have long been some of the well liked riders in amusement parks. Rider load and unload at a platform, typically at the low elevation. At the beginning of each ride cycle, a roller coaster vehicle is locked to be safe to upload riders. Vehicle is then released to gain kinetic energy from potential energy, if it is at the highest point of the track, or from electrical motor installed on the vehicle or track. The roller coaster track typically includes various loops, turns, inversions and other configuration intended to thrill the rider. A number of amusement rides have been devised in which riders can apparently race each other in a simulated dragster format.

Traditional roller coasters travel along rail tracks and provide their riders with stationary seat which fix the motion of the riders to the direction of the travel of vehicle.

The overall effect attained by traditional roller coasters is to statically couple riders to the vehicle and therefore sense essentially the same motions in forces experienced by the vehicles in which they ride. This problem is experienced by most amusement rides, which due to static nature of the ride provides the same ride sensation and experience every time it is ridden.

Nowadays amusement rides have evolved from simple equipment to advanced and technically sophisticated equipment with special mechanisms and various movements. Thanks to virtual reality and by using new technology, new designs and software, riders experience more joy and excitement of amusement rides.

DESCRIPTION

The described roller coaster enables a rider to control his position around a moving cylindrical vehicle/body so that the eccentric rider travels along the helical route around the central axis of the route of the rider.

SUMMARY OF THE INVENTION

Therefore, the object of the present invention is to provide an amusement ride that enables the rider to travel along a complicated route while rider able to control his or her position around a moving cylindrical vehicle/body so that enabling the rider to control direction and pitch of his or her helical motion around the central axis of the route of the rider.

According to this invention, described amusement ride comprising:

An amusement ride enables at least one rider to change and control his position around a cylindrical vehicle while enables said at least one rider to change and control a speed along a central axis of the cylindrical vehicle. Said at least one rider travels along a helical route around the central axis of the cylinder while controls a pitch and a direction of the helical route, comprising:

a track includes at least one supporting column supporting said amusement ride on a ground, and at least one set of running rails wherein said at least one set of running rails has an embark point; said at least one supporting column having a bottom section and a top section, said bottom section of said at least one supporting column adapted to be mounted on the ground, and said top section of said supporting column connected to said at least one set of running rails;

at least one cylindrical vehicle mounted and guided on said at least one set of running rails and arranged to carry said at least one rider along said at least one set of running rails; said at least one cylindrical vehicle comprises a cylindrical shell body having an outer surface;

at least one rotary unit slidably mounted on said outer surface of the cylindrical shell body and moves around the cylindrical shell body while carries said at least one rider;

at least one rotary unit park mechanism installed on the cylindrical shell body to hold said at least one rotary unit while it is loaded;

a drive means installed between the cylindrical shell body and said at least one rotary unit; said drive means generates required power which enables said at least one rider to move said at least one rotary unit around the cylindrical shell body and changing his position laterally around the cylindrical shell body;

at least one launch system accelerating or providing initial motion to said at least one cylindrical vehicle;

at least one cylindrical vehicle park mechanism installed on the ground to hold said at least one cylindrical vehicle at said embark point while it is loaded;

at least one bus bar set transferring electrical power to said at least one cylindrical vehicle.

The at least one cylindrical vehicle further comprises at least two sets of bogies mounting and guiding the cylindrical shell body on said at least one running rails.

The at least one cylindrical vehicle moves along said at least one running rails which configured with one or more of groups consisting of turns, loop, and inversion.

The at least one rotary unit further comprises a main body having a bottom section an upper section, front section, and a rear section.

The at least one rotary unit further comprises a seat installed at said upper section of the main body for the purpose of seating said at least one rider, the seat includes two grippers installed laterally on said front section of said at least one seat.

The bottom section of the main body slidably connected to said outer surface of the cylindrical shell body.

The at least one rotary unit moves around the cylindrical shell body through an arc and limited by two endpoints.

The at least one rotary unit further comprises at least one restraint means to maintain said at least one rider safely.

The at least one drive means further comprises at least one set of motor gearbox and pinion, and at least one set of arc rack gear segments.

The at least one drive means further comprises a joystick installed on each one of said two grippers; said joystick enables said at least one rider to send commands to said at least one drive means changing his position around the cylindrical shell body, at least one button installed on each one of said two grippers for the purpose of interacting such as shooting between said at least one rider and virtual reality images wherein said at least one rider has headset and is watching virtual reality images.

The at least one cylindrical vehicle further comprises at least two shock absorbers installed on the cylindrical shell body and at both sides of said at least one rotary unit, said at least two shock absorbers safely damping kinetic energy of said at least one rotary unit wherein said at least one rotary unit accidentally passes said two end points.

Furthermore, the described amusement ride with another aspect comprising:

a track includes at least one supporting column supporting said amusement ride on a ground, and at least one set of running rails wherein said at least one set of running rails has an embark point;

at least one cylindrical vehicle mounted and guided on said at least one set of running rails and arranged to carry said at least one rider along said at least one set of running rails; said at least one cylindrical vehicle has a speed along said at least one set of running rails and comprises a cylindrical shell body having an outer surface;

at least one rotary unit slidably mounted on said outer surface of the cylindrical shell body and moves around the cylindrical shell body while carries said at least one rider;

a drive means installed between the cylindrical shell body and said rotary unit; said drive means generates required power which enables said at least one rider to move said at least one rotary unit around the cylindrical shell body and changing his position laterally around the cylindrical shell body;

a friction drive means mounted on said at least one cylindrical vehicle, said friction drive means generates required power which enables said at least one rider to change a speed of said at least one cylindrical vehicle along said at least one set of running rails during a riding;

at least one launch system accelerating or providing initial motion to said at least one cylindrical vehicle;

at least one cylindrical vehicle park mechanism installed on the ground to hold said at least one cylindrical vehicle at said embark point while it is loaded;

at least one bus bar set transferring electrical power to said at least one cylindrical vehicle.

The friction drive means further comprises a drive blade fixed on said at least one set of running rails and extended through said at least one running rails, at least one set of motor gearbox and roller mounted to the cylindrical shell body and adapted to engage an outer surface of said drive blade.

The friction drive means further comprises a freewheel clutch disengages said friction drive means while said at least one cylindrical vehicle is being launched by said at least one launch system.

The friction drive means is activated by the means of said joystick.

Furthermore, the described amusement ride with another aspect comprising:

a vehicle track includes at least one column supporting said amusement ride on a ground, and at least one set of vehicle running rails wherein said at least one set of vehicle running rails has an embark point;

at least one vehicle mounted and guided on said at least one set of vehicle running rails and arranged to carry at least one rider along said at least one set of vehicle running rails; said at least one vehicle comprises a vehicle main body having a top section, a bottom section, at least two sets of vehicle bogies installed at a rear end and a front end of said bottom section of the vehicle main body, each of said at least two sets of vehicle bogies includes at least two vehicle bogies for the purpose of mounting and guiding said at least one vehicle on said at least one vehicle running rails, and at least one cylindrical body installed at said top section of the vehicle main body, said at least one cylindrical body has an outer surface;

at least one rotary unit slidably mounted on said outer surface of said at least one cylindrical body and moves around said at least one cylindrical body while carries said at least one rider;

a drive means installed between said at least one cylindrical body and said at least one rotary unit; said drive means generates required power which enables said at least one rider to move said at least one rotary unit around said at least one cylindrical body and changing his position laterally around said at least one cylindrical body;

at least one rotary unit park mechanism installed on said at least one cylindrical body to maintain said at least one rotary unit while it is loaded;

at least one launch accelerating or providing initial motion to said at least one vehicle;

a vehicle park mechanism installed on a ground to maintain said at least one vehicle at the embark point while it is loaded; and, at least one bus bar set transferring electrical power to said at least one vehicle.

The at least one vehicle moves along said at least one vehicle running rails which configured with one or more of groups consisting of turns, loop, and inversion.

The at least one slip-rings installed on said at least one rotary unit; said at least one slip-ring transfers electrical power to said at least one rotary unit wherein said at least one rotary unit rotates unlimited around said at least one cylindrical body.

The drive means further comprises a joystick enables said at least one rider to activate the drive means, at least one button installed on each one of said two grippers for the purpose of interacting such as shooting between said at least one rider and virtual reality images wherein said at least one rider has headset and is watching virtual reality images.

BRIEF DESCRIPTION OF DRAWINGS

Other features and advantages of described invention will become apparent in the following detailed description of preferred embodiments with reference to the appended drawings, of which.

DETAILED DESCRIPTION OF EMBODIMENT

Figure 1:
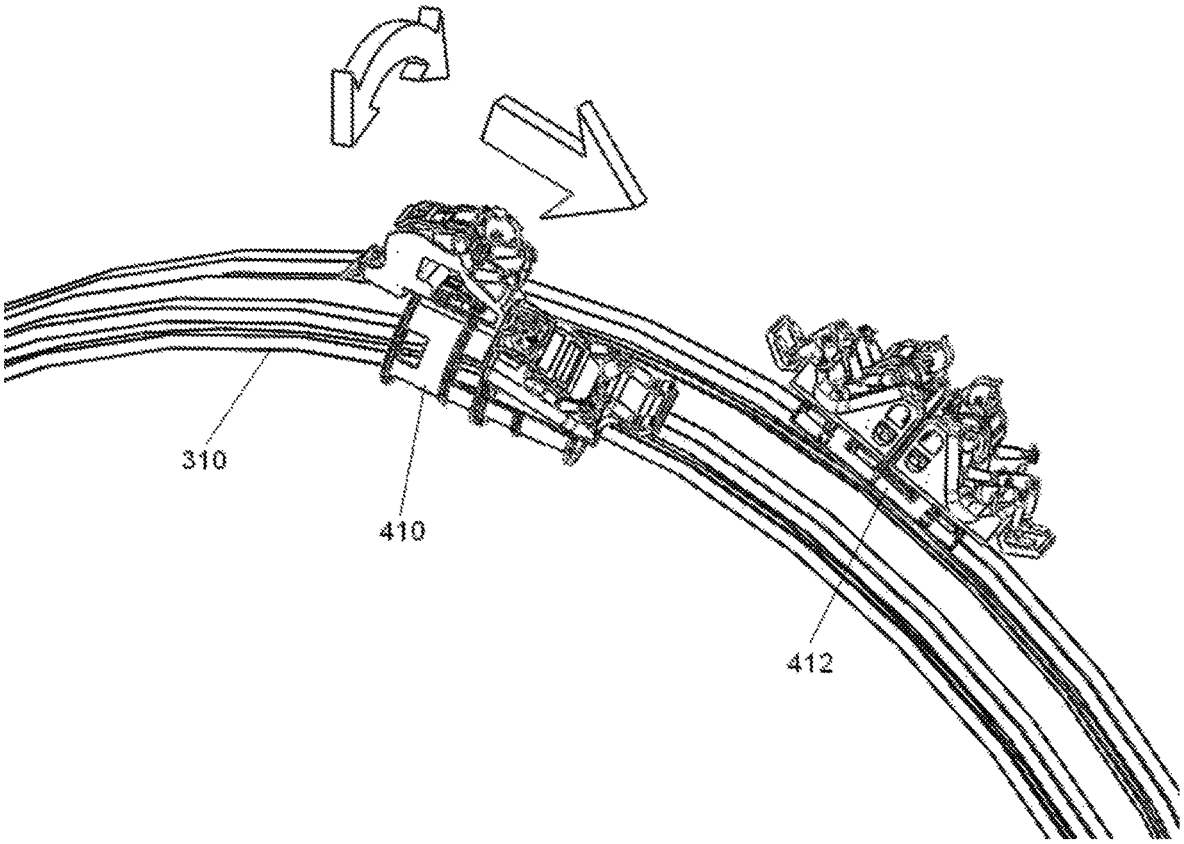
FIG. 1 is a perspective view of described amusement ride for the purpose of showing two racing vehicles, and direction of moving the vehicles and rotating direction of independent riders.
Figure 2:
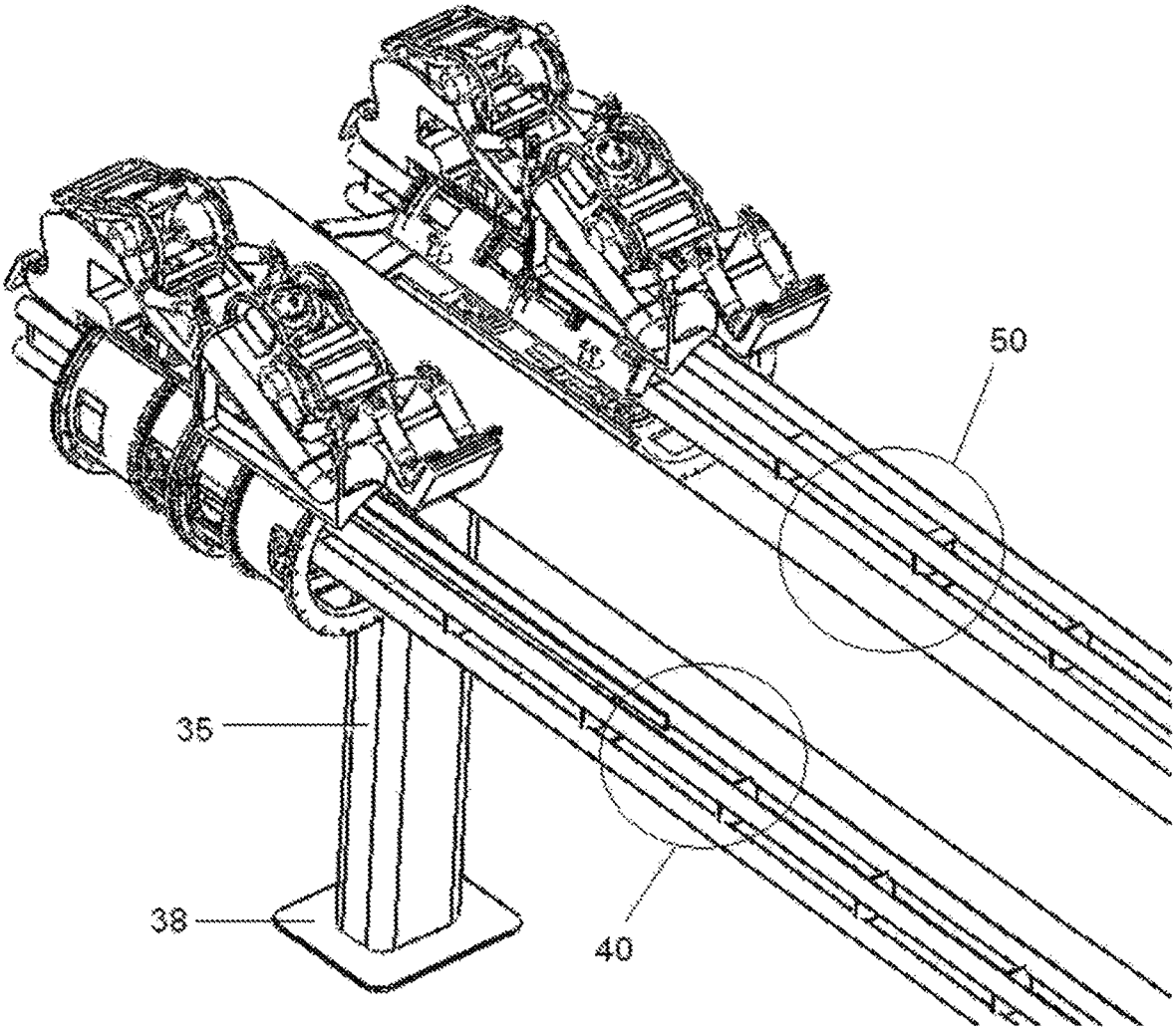
FIG. 2 is a perspective view of two racing vehicle at the embark point.
Figure 3:
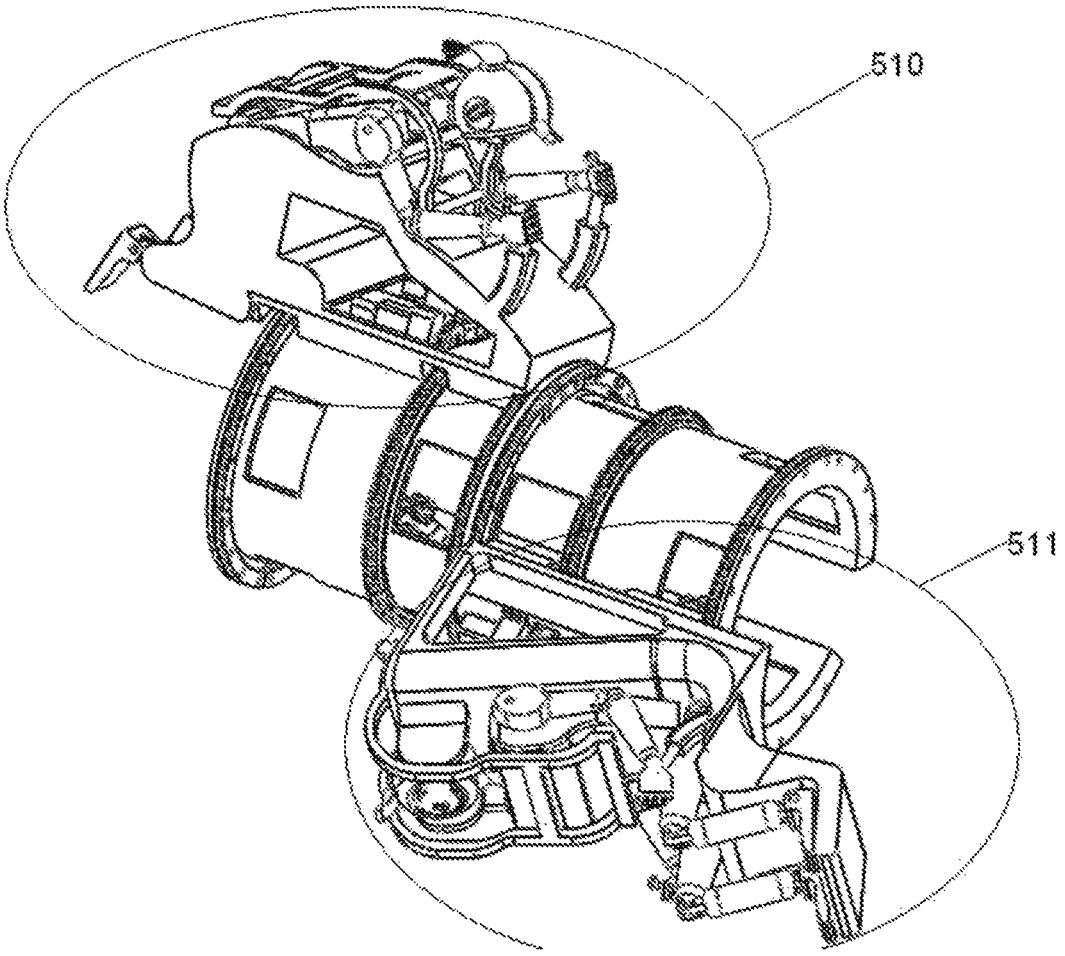
FIG. 3 is a perspective view of the cylindrical vehicle shows the eccentric rider and his ability to change his position around the cylindrical vehicle.
Figure 4A:
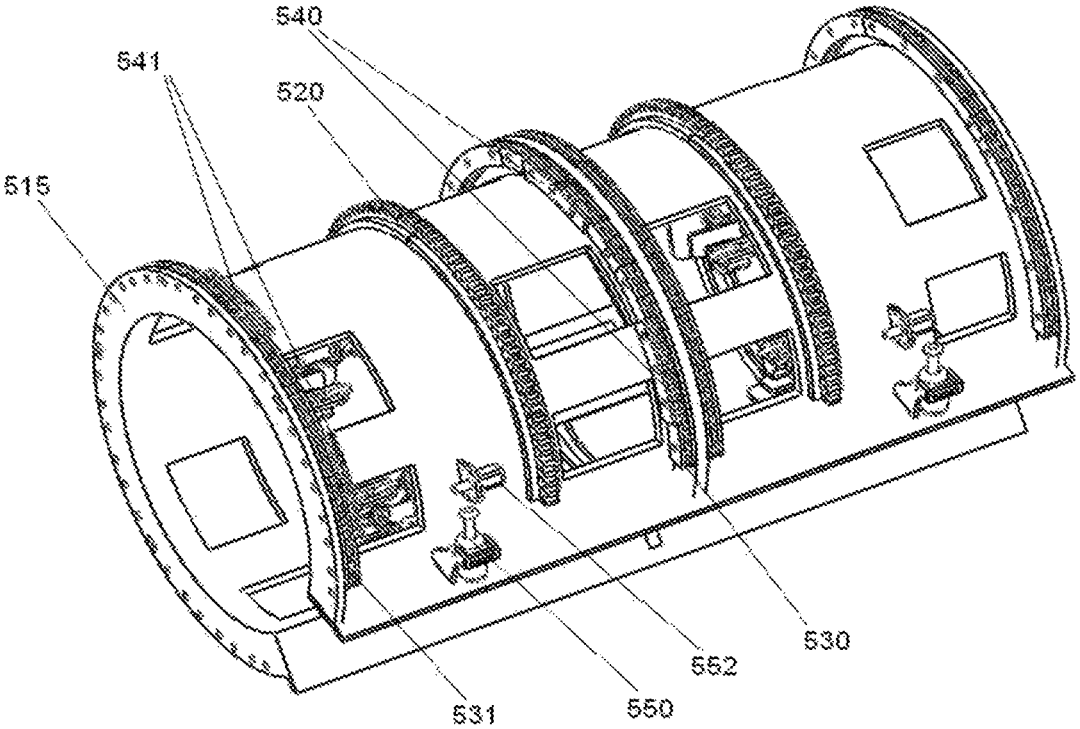
FIG. 4A is a perspective view of the cylindrical vehicle shows components such as shock absorbers, arc rail segments, arc bearing, rack gear segments and rotary unit park mechanism at the embark point.
Figure 4B:
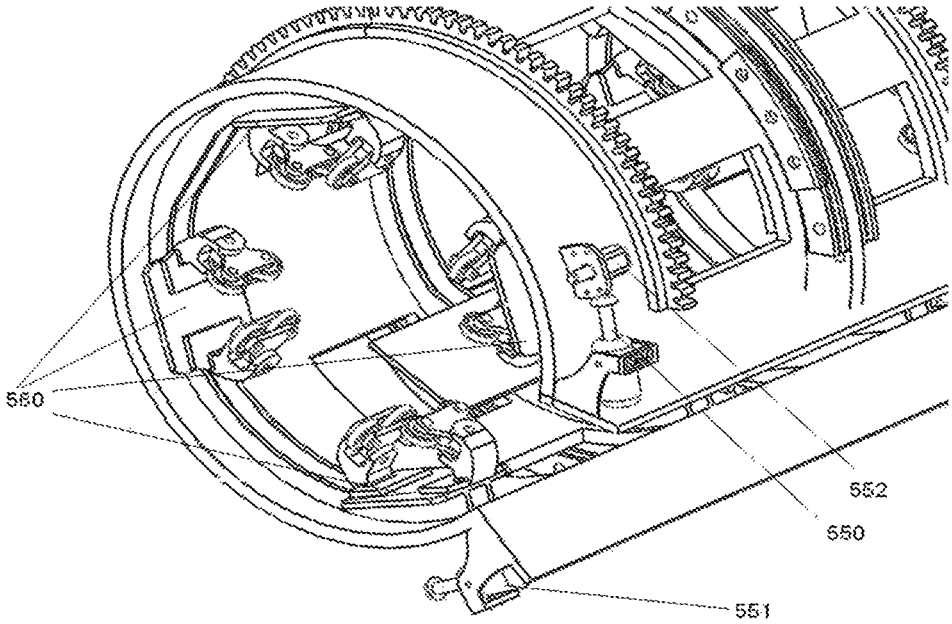
FIG. 4B is a perspective view of the cylindrical vehicle shows bogies layout at the rear end of the cylindrical vehicle.
Figure 5:
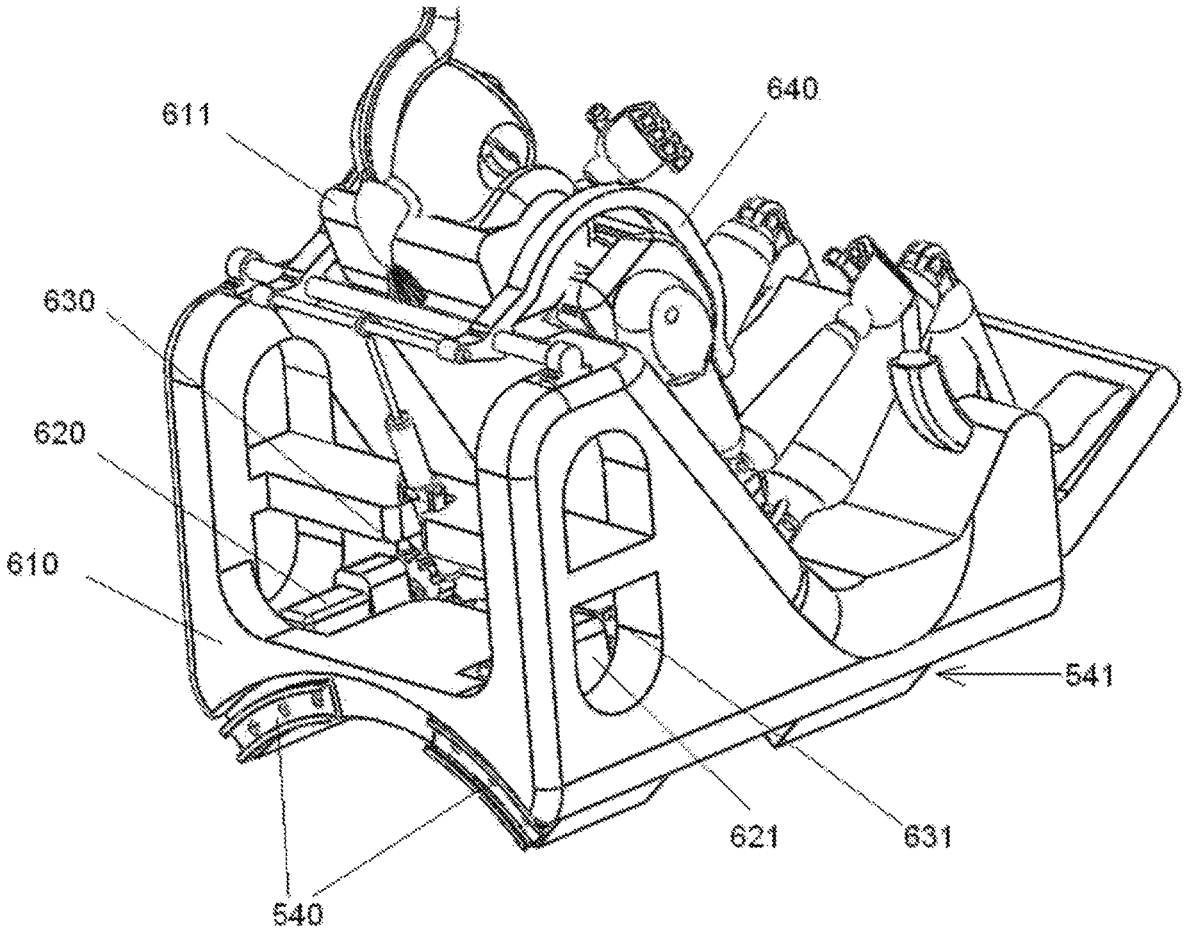
FIG. 5 is a perspective view of the rotary unit shows all components such as main body, seat, motor gearbox and pinion, restrain and arc bearings.
Figure 6:
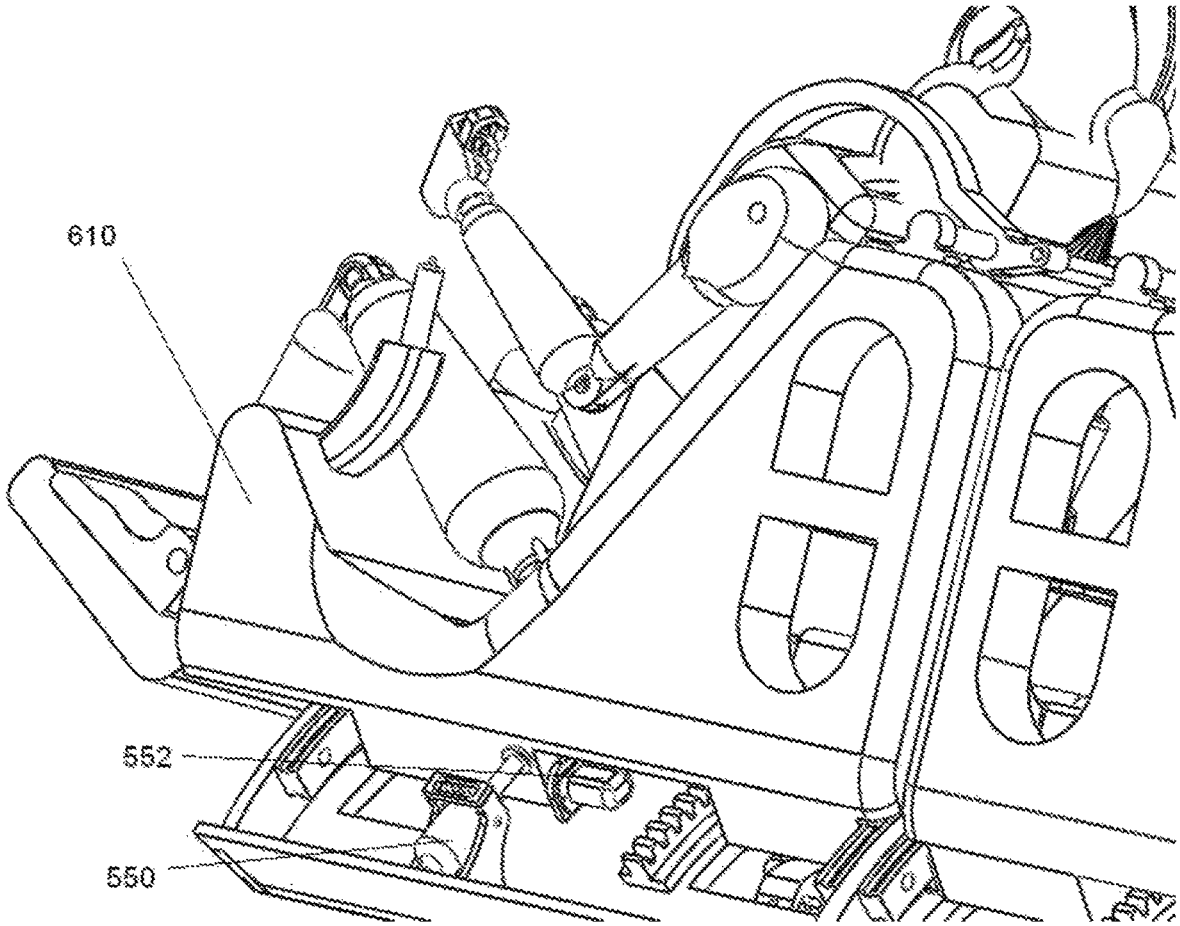
FIG. 6 is a perspective view of rotary unit and vehicle shows how shock absorber stops rotary unit in the case that the rotary unit passes stop point.
Figure 7:
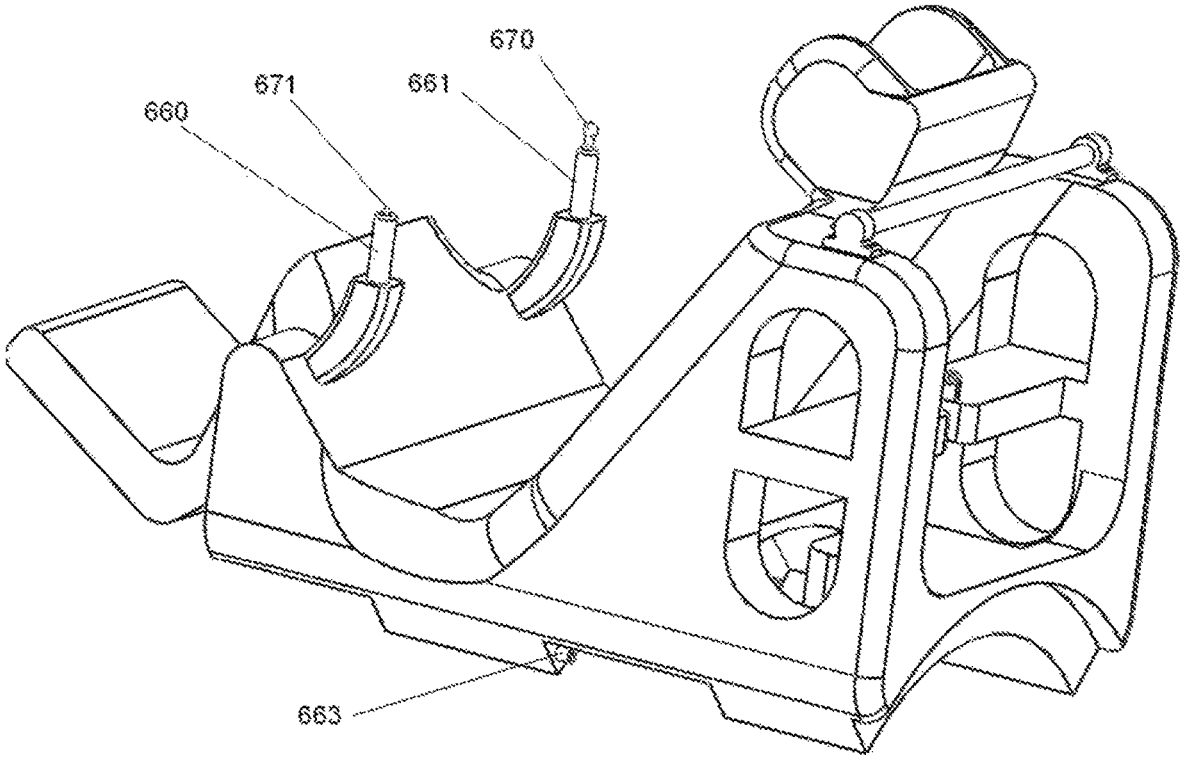
FIG. 7 is a perspective view of main body and seat of the rotary unit shows grippers, fire button and joystick.
Figure 8A:
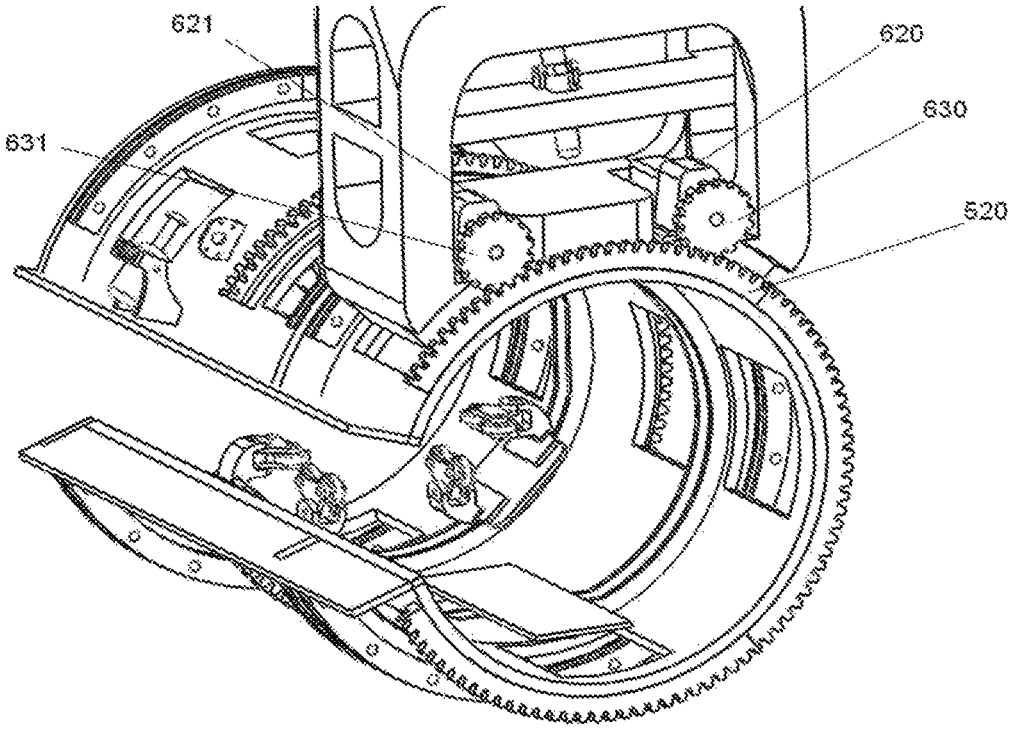
FIG. 8A is a perspective view of power transmission system shows how motor gearbox and pinion is engaged to rack gear segments of the cylindrical vehicle.
Figure 8B:
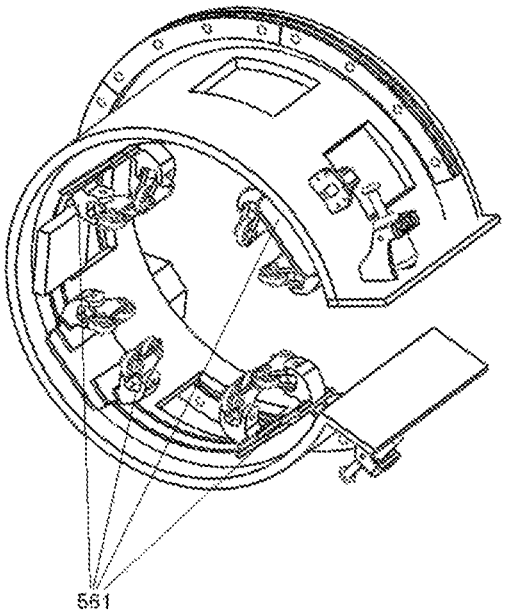
FIG. 8B is a perspective section view of vehicle shows bogies layout at the front end of the cylindrical vehicle.

The description which follows and the embodiments described therein are provided by way of illustration of an example of particular embodiment of principles of present invention. This example is provided for the purposes of explanation and not limitation of those principles and of the invention.

Referring to FIGS. 1 to 15, the preferred embodiment of an amusement ride, according to present invention is shown to comprise:

Track 310, cylindrical vehicles 410 & 412, rotary units 510 & 511, rotary unit park mechanism 552, launch system 720, bus bars 730, cylindrical vehicle park mechanism 532.

The track 310 including at least one supporting column 35 for the purpose of supporting said amusement ride on the supporting surface, and running rails 40, 50, wherein running rails has an embark point; said at least one supporting column 35 having a base plate 38 adapted to be mounted on a supporting surface, and column arms 316, 311 connected to the running rails 40, 50. (See FIGS. 2, 12)

The cylindrical vehicle 410 & 412 arranged to each carry two riders along the respective running rail, each cylindrical vehicle includes a cylindrical shell body 515 having a front end and a rear end, an, inner surface, an outer surface, two sets of bogies 560, 561 installed at said rear end and said front end of the cylindrical shell body and at said inner surface of the cylindrical shell body, each of said set of bogie includes four bogies for the purpose of mounting and guiding the cylindrical vehicle on respective said running rail, two sets of arc rail segments 530, 531 per each rider installed on the outer surface of said cylindrical shell main body, one set of arc rack gear segments 520 installed on said outer surface of said cylindrical shell main body, and two shock absorbers 550, 551 per each rider installed laterally at both sides of rider on the cylindrical shell body of the cylindrical vehicle. (See FIGS. 4A, 4B, and 8B)

The rotary units 510, 511, each rotary unit including the main body 610 having a bottom section, an upper section, a rear section, and a front end, the seat 611 installed at the upper section of the main body 610 for the purpose of seating rider, at least one set of motor gearbox and pinion 620, 630, and 621, 631, installed at said rear section of the main body of the rotary unit, the pinions 630, 631 are engaged with said set of arc rack segments 520 for the purpose of generating required torque to move rotary unit around cylindrical shell body of the vehicle, the revolution of said motor gearbox and pinion is adjustable by the rider from zero to a maximum revolution, at least two sets of arc bearings 540, 541 fixed at a front and a rear of the bottom section of the main body, each set of said two sets of arc bearing includes two arc bearings and slidably connected to respective said set of rail segments 530, 531 for the purpose of guiding the rotary unit around the cylindrical shell body 515 of the cylindrical vehicle, the pneumatic/mechanical restrain per each rider 640 installed at the rear section of the main body 610 for the purpose of keeping rider safely during the riding, and at least one belt installed on the seat to keep rider safely during riding, said seat 611 includes two grippers 660, 661 installed laterally on the seat helping rider to hold himself at his/her position safely, the gripper 661 includes joystick 670 at a top to send commands to said set of motor gearbox and pinion 620, 621, and 630, 631 for the purpose of changing position of the rider around said cylindrical shell body 515, the angular velocity of the rotary unit around the cylindrical shell body is adjustable by the means of the joystick, the gripper 660 includes at least one button 671 at a top for the purpose of interacting such as shooting between rider and virtual reality images while rider has VR headset and is watching virtual reality images during riding. (See FIG. 7)

The rotary unit park mechanism 552 installed on the outer surface of said cylindrical shell body 515 for the purpose of parking said rotary unit while it is loaded. The main body of the rotary unit 610 further includes proper housing 663 to be engaged with said rotary unit park mechanism 552 keeping rotary unit while it is loaded. (See FIGS. 6, 7)

The launch system 720 includes at least one linear synchronous motor installed on the inner ring of said cylindrical shell body of the cylindrical vehicle, and at least one linear stator installed on the respective running rail for the purpose of accelerating/decelerating said cylindrical vehicle. (See FIG. 12)

The cylindrical vehicle park mechanism 532 installed on the ground for the purpose of parking said cylindrical vehicle in the embark point while it is loaded. (See FIG. 9B)

The bus bar set 730 includes moving parts installed at the inner surface of the cylindrical shell body of the cylindrical vehicle, and stators installed on the respective running rail for the purpose of transferring electrical power to the cylindrical vehicle during riding. (See FIG. 12)

Another Aspect of Described Amusement Ride

Another aspect and advantages of described invention will become apparent in the following description.

Figure 9A:
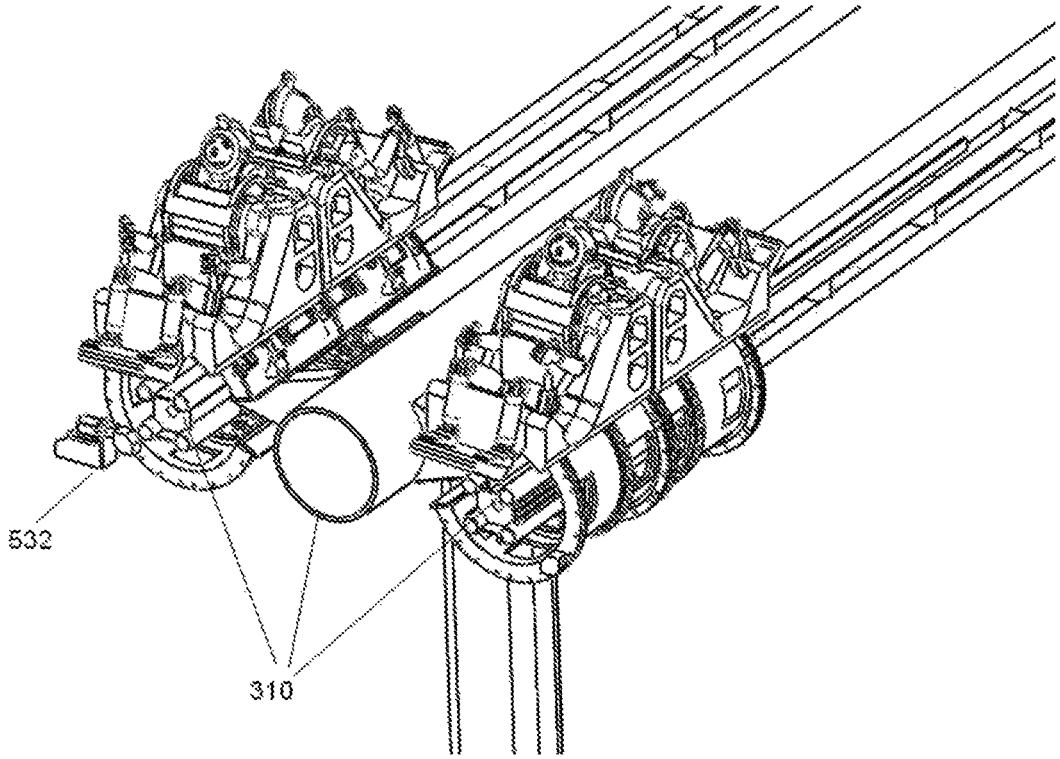
FIG. 9A is a perspective view of another aspect of the invention shows vehicle with different seats and configuration installed on the running rails.
Figure 9B:
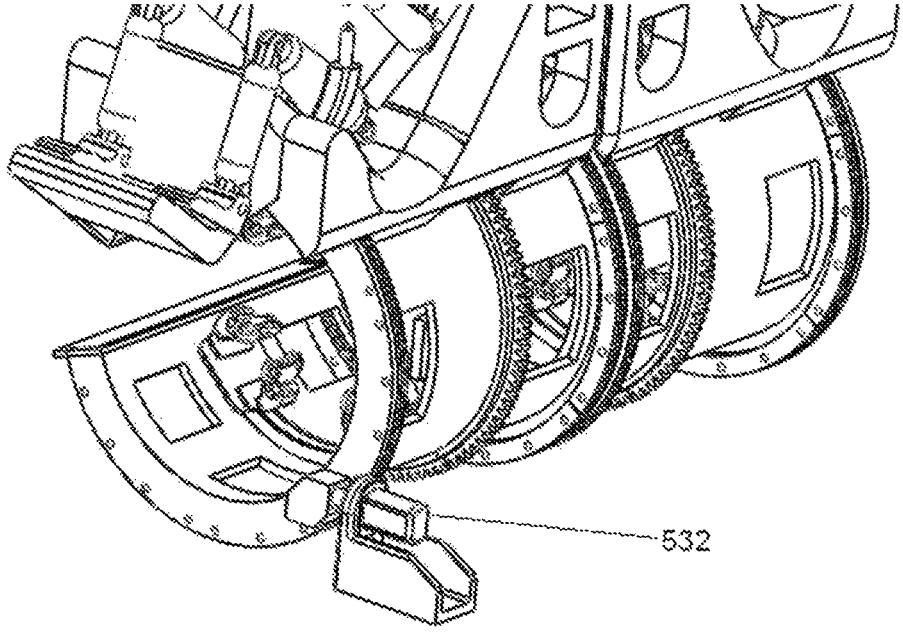
FIG. 9B is a perspective view of another aspect of the invention shows cylindrical vehicle park mechanism at the embark point.
Figure 10:
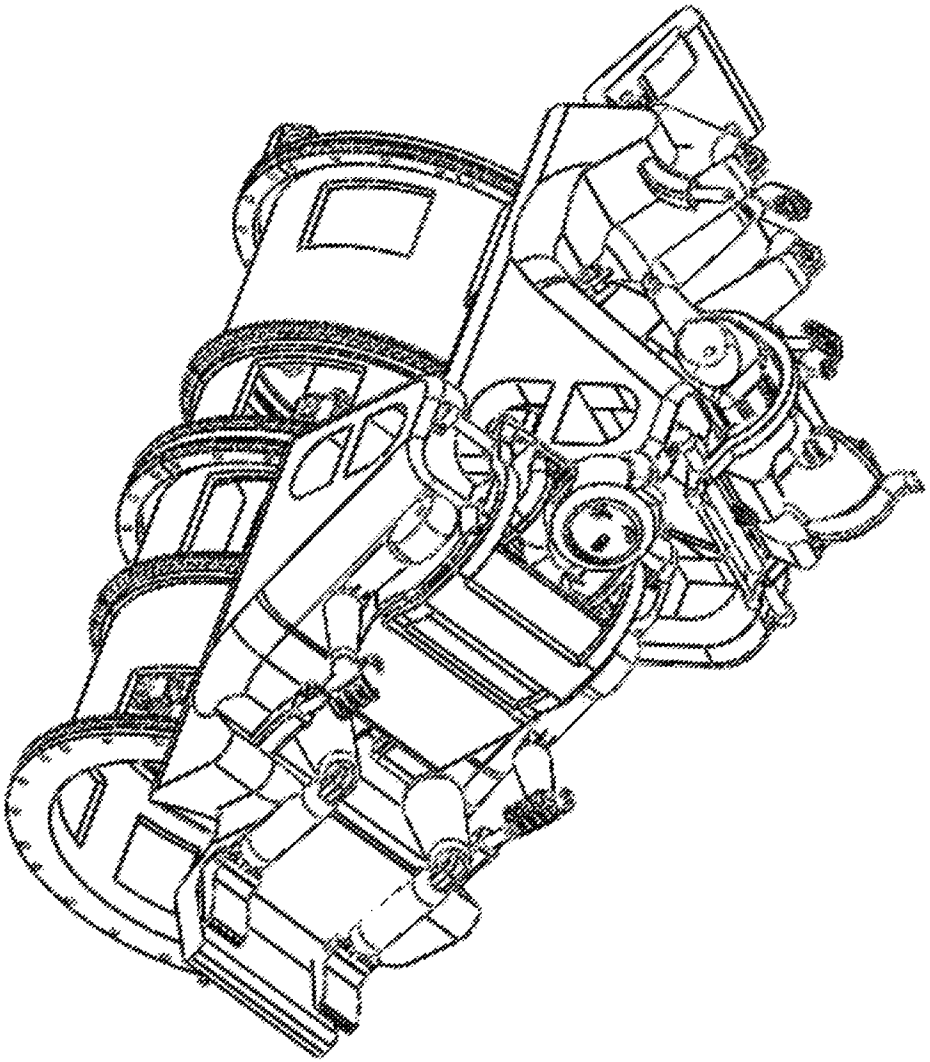
FIG. 10 is a perspective view of vehicle shows the position of the two rotary units around the cylindrical vehicle in new configuration.

The rotary unit of described ride can be configured so that riders are seated back to back as shown in FIG. 9A and FIG.

10. All acceleration and deceleration rates must be in the acceptable ranges according to the standards. (See FIG. 10)

Figure 11:
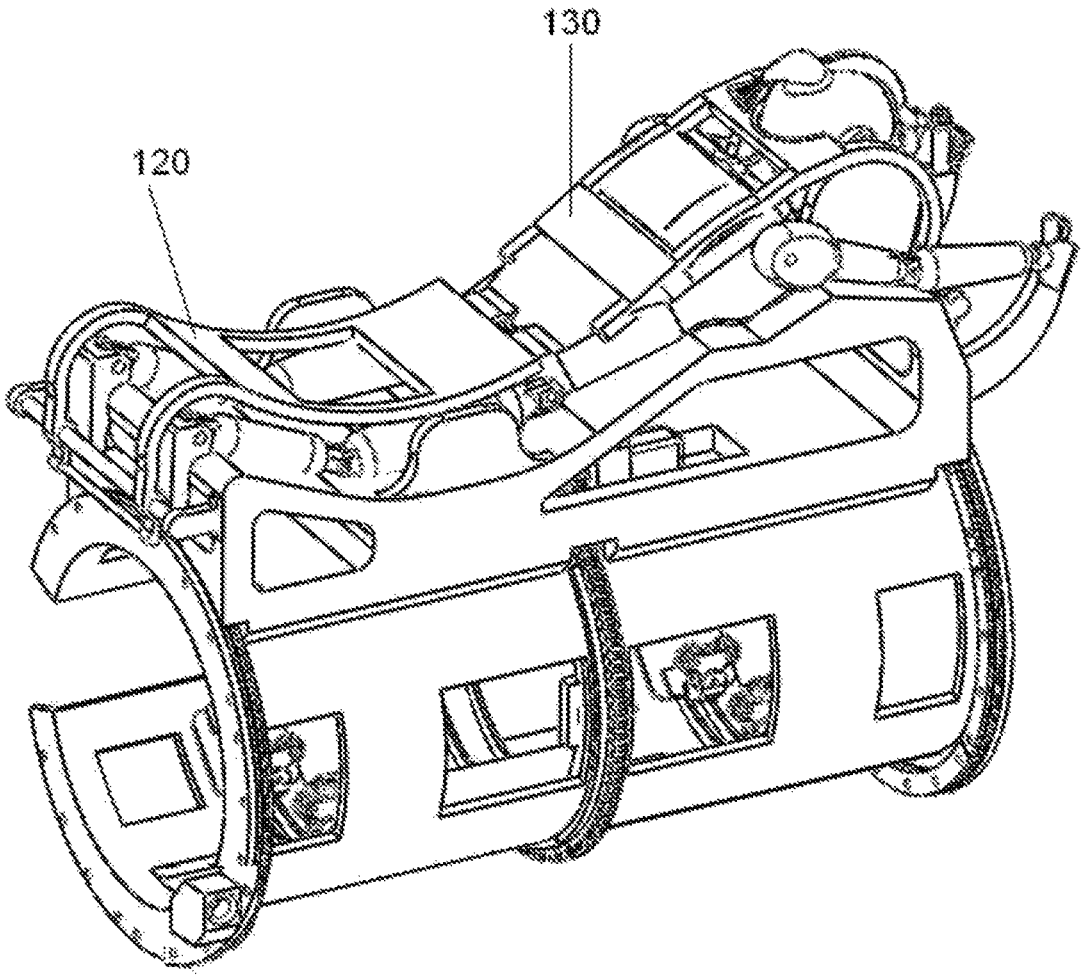
FIG. 11 is a perspective view of another aspect of the invention shows new configuration of the rotary module, seat, and rider. The rider is laying prone on the seat.
Figure 12:
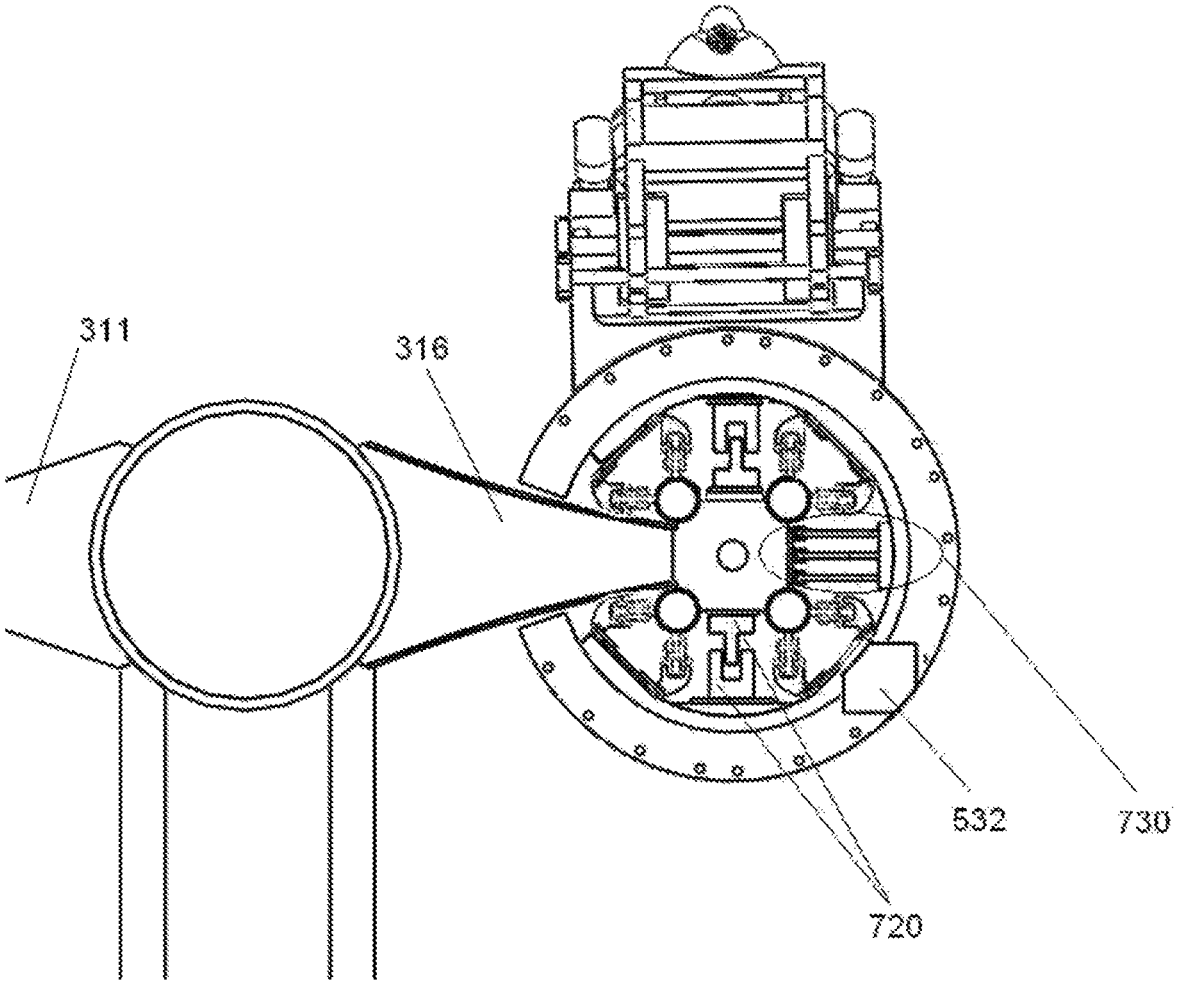
FIG. 12 is a perspective view of rotary unit and cylindrical vehicle installed on the track shows the bus bars, the lunch system, and how vehicle is installed on the track.
Figure 13A:
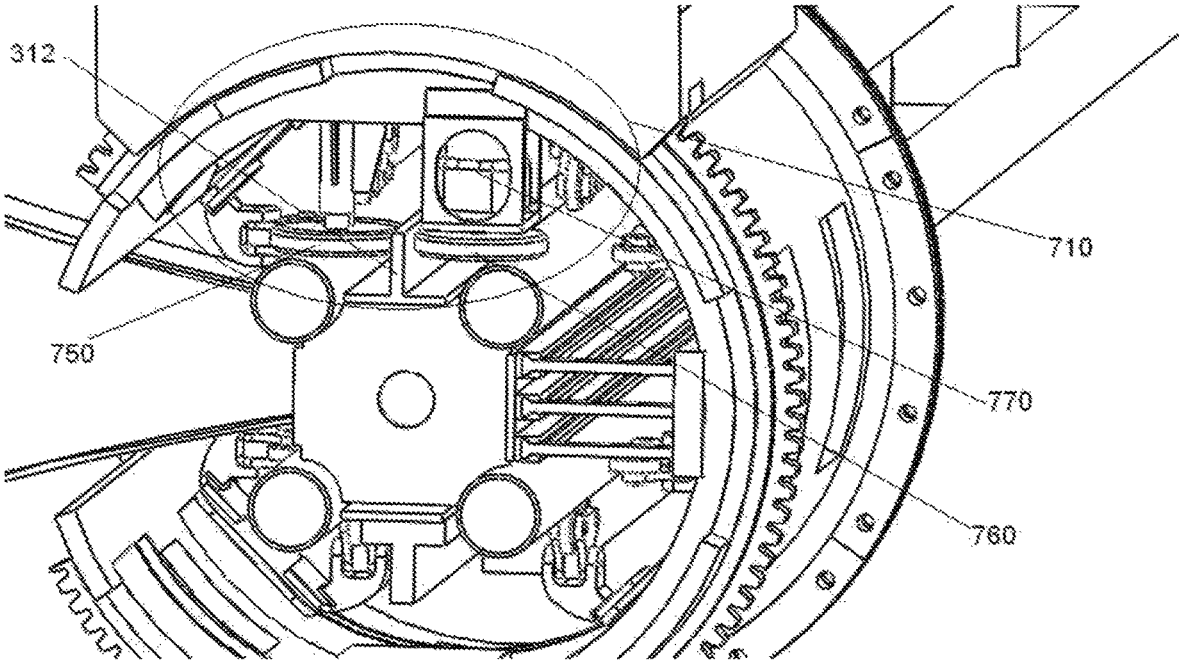
FIG. 13A is a perspective view of vehicle and track shows more details about vehicle installation on the track and vehicle's propulsion system.
Figure 13B:
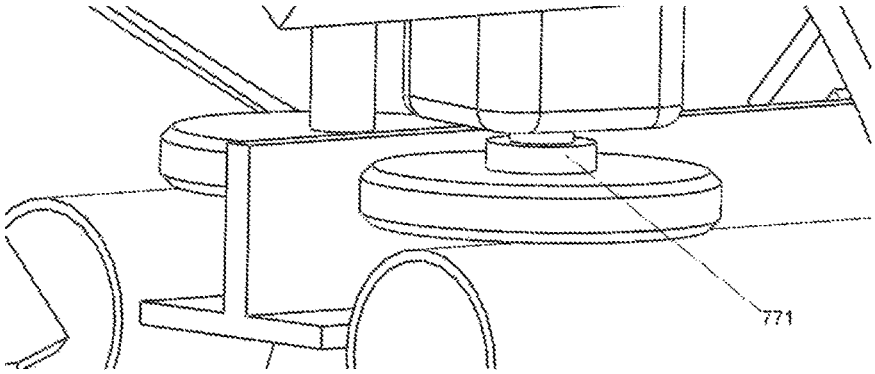
FIG. 13B is a perspective view of vehicle and track shows more details about propulsion system and freewheel clutch.

Furthermore the rotary unit of described ride can be configured to carry single prone rider as shown in FIG. 11; a friction drive means enables the rider accelerating/decelerating the cylindrical vehicle and control the speed of the cylindrical vehicle during the riding; the single prone rider is maintained safely by the means of the restrains 120, 130 during the riding; the joystick 670 is pushed to left and right to change position of the rider around cylindrical vehicle; as an optional choice joystick 670 can be pushed forward to activate the friction drive means 710 and consequently increases the speed of the cylindrical vehicle.

The friction drive means includes at least one set motor gearbox 770 fixed at the inner surface of the cylindrical shell body of the cylindrical vehicle having an output shaft, a freewheel clutch 771 having an outer ring and an inner ring, said inner ring of the free wheel clutch fixed on said output shaft of said at least one set of motor gearbox 770, a driver roller 760 whose center fixed on said outer ring of said freewheel clutch 771 and having outside surface tangentially connected to the friction blade 312 of the respective running rail, and a roller 750 whose center is rotatably connected to the inner surface of said cylindrical shell body of said cylindrical vehicle and having outside surface tangentially connected to the friction blade 312 of the respective running rails; said joystick 670 enabling the rider to send a command to the friction drive means 710 and accelerating the cylindrical vehicle (See FIG. 11, 13A, 13B)

Another aspect and advantages of described invention will become apparent in the following description.

Figure 14:
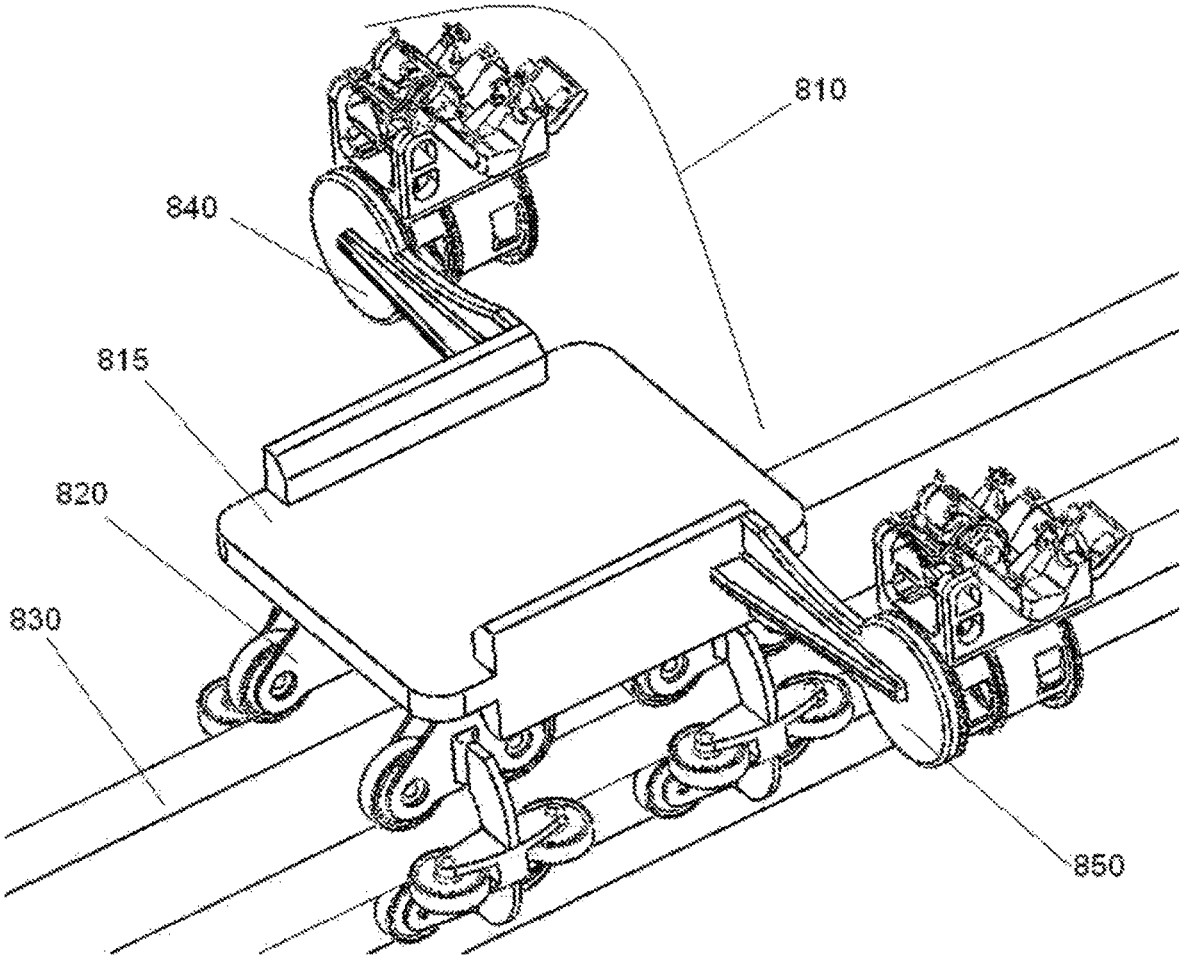
FIG. 14 is a perspective view of another aspect of the invention shows track with new design which enables rider to rotate unlimited around the cylinder vehicle.
Figure 15:
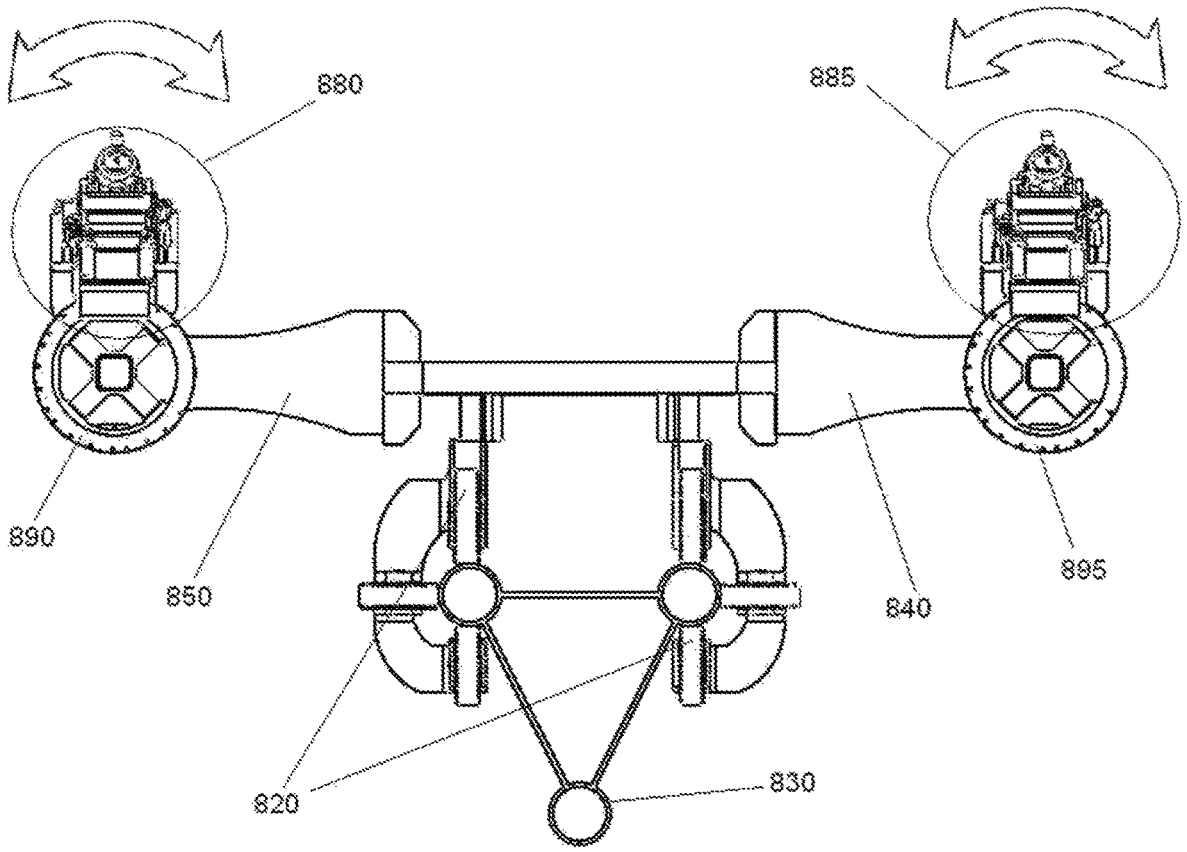
FIG. 15 is a schematic view of new vehicle shows how new vehicle is installed on the track.

The described ride can be configured as shown in FIG. 14 and FIG. 15 and FIG. 16 so that vehicle 810 is guided on the running rail 830 by the means of at least four of bogies 820.

The vehicle arranged to carry at least two rider along the running rail 830 includes a vehicle main body 815 having a top section, a bottom section, and a reference plane passing through a middle of the vehicle main body longitudinally and perpendicular to the top section of the said vehicle main body, at least two sets of bogies installed at a rear end and a front end of the bottom section of the vehicle main body, each of said at least two sets of bogies includes at least two bogies of bogies 820 for the purpose of mounting and guiding the vehicle on respective said running rail, at least two arms 840, 850 fixed laterally at the top section of the vehicle main body 815, said at least two arms 840, 850 installed symmetrically in relation to the reference plane, at least two cylindrical bodies 890, 895, each cylindrical body having a front end, a rear end, and an outer surface, said rear ends of said cylindrical bodies 890, 895 fixed at the end of the each respective said arms 850, 840, two sets of arc rail segments per each rider installed on the outer surface of each said cylindrical body of the vehicle, at least one set of arc rack gear segments installed on said outer surface of each said cylindrical body of the vehicle;

at least two rotary units 880, 885 installed on said cylindrical main bodies 890, 895 of the vehicle; In this configuration rotary units 880, 885 enables the riders rotating unlimited around the cylindrical bodies 890, 895; The cylindrical slip-ring installed on each cylindrical body of the vehicle transferring electrical power from cylindrical body of the vehicle to rotary unit; at least two rotary unit park mechanisms installed on the outer surface of each said cylindrical body of the vehicle for the purpose of parking said rotary unit while it is loaded;

a launch system includes at least one linear synchronous motor installed at the bottom section of the main body of the vehicle 810, and at least one linear stator installed on the respective running rail 830 for the purpose of accelerating/decelerating the vehicle;

a vehicle park mechanism installed on the ground for the purpose of parking the vehicle in the embark point while it is loaded;

at least one set bus bar includes moving parts installed at the bottom section of main body 815 of the vehicle 810, and stators installed on the respective running rail 830 for the purpose of transferring electrical power to the vehicle during the riding. (See FIGS. 14, 15)

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangement.

What is claimed is:

1. An amusement ride enabling at least one rider to change a position of said at least one rider around at least one cylindrical vehicle while said at least one cylindrical vehicle carries said at least one rider along a central axis of said at least one cylindrical vehicle during a riding, comprising:

a track includes at least one supporting column supporting said amusement ride on a ground, and at least one set of running rails wherein said at least one set of running rails has an embark point; said at least one supporting column having a bottom section and a top section, said bottom section of said at least one supporting column adapted to be mounted on the ground, and said top section of said supporting column connected to said at least one set of running rails;

at least one cylindrical vehicle mounted and guided on said at least one set of running rails and arranged to carry said at least one rider on said at least one set of running rails; said at least one cylindrical vehicle comprises a cylindrical shell body having an outer surface;

at least one rotary unit slidably mounted on said outer surface of the cylindrical shell body, wherein the at least one rotary unit moves around the cylindrical shell body while carrying said at least one rider, said at least one rotary unit further comprises a main body, and at least one seat adapted to be mounted on the main body for the purpose of seating said at least one rider;

a drive means installed between the cylindrical shell body and said at least one rotary unit; said drive means generates required power enabling said at least one rider to move said at least one rotary unit around the cylindrical shell body and changing the position of said at least one rider laterally around the cylindrical shell body;

at least one launch system accelerating or providing initial motion to said at least one cylindrical vehicle; and, at least one bar set transferring electrical power to said at least one cylindrical vehicle.

2. The amusement ride of claim 1 wherein said at least one cylindrical vehicle further comprises at least two sets of bogies mounting and guiding the cylindrical shell body on said at least one set of running rails.

3. The amusement ride of claim 1 wherein said at least one cylindrical vehicle moves along said at least one set of running rails which is configured with one or more of groups consisting of turns, loop, and inversion.

4. The amusement ride of claim 1 wherein the main body of said at least one rotary unit is slidably connected to the cylindrical shell body, said at least one rotary unit rotates around the cylindrical shell body.

5. The amusement ride of claim 1 wherein said at least one rotary unit further comprises at least one restraint means to maintain said at least one rider safely.

6. The amusement ride of claim 1 wherein said at least one drive means further comprises at least one set of motor gearbox and pinion, and at least one set of arc rack gear segments.

7. The amusement ride of claim 1 wherein said at least one drive means further comprises a joystick installed on said at least one seat; said joystick enabling said at least one rider to send commands to said at least one drive means changing the position of said at least one rider around the cylindrical shell body.

8. The amusement ride of claim 1 wherein said at least one drive means further comprises at least one button installed on said at least one seat, said at least one button interacting between said at least one rider and virtual reality images wherein said at least one rider has a headset and said at least one rider is watching virtual reality images.

9. An amusement ride, comprising:

a track includes at least one supporting column supporting said amusement ride on a ground, and at least one set of running rails wherein said at least one set of running rails has an embark point;

at least one cylindrical vehicle mounted and guided on said at least one set of running rails and arranged to carry at least one rider on said at least one set of running rails; said at least one cylindrical vehicle comprises a cylindrical shell body having an outer surface;

at least one rotary unit slidably mounted on said outer surface of the cylindrical shell body, wherein the at least one rotary unit moves around the cylindrical shell body while carrying said at least one rider, said at least one rotary unit further comprises a main body, and a seat adapted to be mounted on the main body for the purpose of seating said at least one rider, said at least one rotary unit further comprises at least one restraint means to maintain said at least one rider safely;

a drive means installed between the cylindrical shell body and said rotary unit; said drive means generates required power enabling said at least one rider to move said at least one rotary unit around the cylindrical shell body and changing the position of said at least one rider laterally around the cylindrical shell body;

a friction drive means mounted on said at least one cylindrical vehicle, said friction drive means generates required power enabling said at least one rider to change a speed of said at least one cylindrical vehicle along said at least one set of running rails during a riding;

at least one launch system accelerating or providing initial motion to said at least one cylindrical vehicle; and, at least one bar set transferring electrical power to said at least one cylindrical vehicle.

10. The amusement ride of claim 9 wherein, said drive means is activated by a joystick installed on said seat.

11. The amusement ride of claim 9 wherein the friction drive means further comprises a drive blade fixed on said at least one set of running rails and extended through said at least one set of running rails, at least one set of motor gearbox and roller mounted to the cylindrical shell body and adapted to engage an outer surface of said drive blade.

12. The amusement ride of claim 9 wherein the friction drive means further comprises a freewheel clutch for disengaging said friction drive means while said at least one cylindrical vehicle is being launched by said at least one launch system.

13. The amusement ride of claim 9 wherein said friction drive means is activated by the joystick.

14. An amusement ride, comprising:

a vehicle track including at least one column supporting said amusement ride on a ground, and at least one set of vehicle running rails which are configured with one or more of groups consisting of turns or loop or inversion, wherein said at least one set of vehicle running rails has an embark point;

at least one vehicle mounted and guided on said at least one set of vehicle running rails and arranged to carry at least one rider along said at least one set of vehicle running rails; said at least one vehicle comprises a vehicle main body, and at least one cylindrical body installed on the vehicle main body and projecting away from the vehicle main body;

at least one rotary unit rotatably mounted on said at least one cylindrical body, and distal from an axis of rotation, wherein said at least one rotary unit rotates around said at least one cylindrical body while said at least one vehicle carrying said at least one rider along said at least one set of vehicle running rails, said at least one rotary unit comprises a main body mounted on said at least one cylindrical body, at least one seat adapted to be mounted on the main body for the purpose of seating said at least one rider, and at least one restraint means to maintain said at least one rider safely; said amusement ride enabling the rider to rotate laterally around a distal axis while said rider is moving along said distal axis; and, at least one launch system accelerating or providing initial motion to said at least one vehicle.

15. The amusement ride of claim 14 wherein said at least one vehicle further comprises at least two sets of vehicle bogies mounting and guiding said main body of said at least one vehicle on said at least one vehicle running rails.

16. The amusement ride of claim 14 wherein said at least one vehicle moves along said at least one vehicle running rails which is configured with one or more of groups consisting of turns, loop, and inversion.

17. The amusement ride of claim 14 further comprises at least one drive means installed between said at least one cylindrical body and said at least one rotary unit; said at least one drive means generates required power which enabling said at least one rider to move said at least one rotary unit around said at least one cylindrical body and changing the position of said at least one rider laterally around said at least one cylindrical body.

18. The at least one drive means of claim 17 further comprises a joystick enabling said at least one rider to activate said at least one drive means and control a position around said cylindrical body.

19. The at least one drive means of claim 17 further comprises at least one button interacting between said at least one rider and virtual reality images wherein said at least one rider has a headset and said at least one rider is watching virtual reality images.

20. The amusement ride of claim 14 enabling said at least one rider to rotate around a cylinder while said at least one rider is distal from a central axis of the cylinder and moving along said a central axis of the cylinder.

* * * * *